US005193043A

United States Patent [19]

Grunert et al.

[11] Patent Number: 5,193,043

[45] Date of Patent: Mar. 9, 1993

[54] PHASE SENSITIVITY

[75] Inventors: Kurt A. Grunert, Beaver; Robert J. Tedesco, Coraopolis; John A. Wafer, Brighton Twp., Beaver County; Henry A. Wehrli, III, Monroeville, all of Pa.; Lawrence M. Hapeman, Fletcher, N.C.; Stephen A. Mrenna, Brighton Twp., Beaver County, Pa.

[73] Assignee: Westinghouse Electric Corp., Pittsburgh, Pa.

[21] Appl. No.: 543,985

[22] Filed: Jun. 26, 1990

[51] Int. Cl.[5] ..... H01H 75/10

[52] U.S. Cl. ..... 361/93; 361/24; 361/105

[58] Field of Search ..... 361/93, 24, 32, 106, 361/76, 77, 34, 23, 30; 337/36, 37, 40, 38; 335/176

[56] References Cited

U.S. PATENT DOCUMENTS

| | | | |
|---|---|---|---|
| 2,647,969 | 8/1953 | Marcoz | 200/116 |
| 3,370,142 | 2/1968 | Burch et al. | 200/122 |
| 3,475,709 | 10/1969 | Basse | 337/44 |
| 3,708,771 | 1/1973 | Schreckenberg et al. | 335/176 |
| 3,840,833 | 10/1974 | Mrenna et al. | 337/43 |
| 4,489,295 | 12/1984 | Altenhof, Jr. et al. | 335/20 |
| 4,638,277 | 1/1987 | Thomas et al. | 335/190 |
| 4,656,444 | 4/1987 | McKee et al. | 335/16 |
| 4,679,018 | 7/1987 | McKee et al. | 335/167 |
| 4,691,182 | 9/1987 | Mrenna et al. | 335/176 |
| 4,698,606 | 10/1987 | Mrenna et al. | 335/45 |
| 4,719,438 | 1/1988 | Mrenna et al. | 335/38 |
| 4,725,800 | 2/1988 | Grunert et al. | 335/38 |

*Primary Examiner*—A. D. Pellinen
*Assistant Examiner*—S. Jackson
*Attorney, Agent, or Firm*—M. J. Moran

[57] ABSTRACT

A multipole circuit breaker, for example, a three pole circuit breaker, can detect a condition when less than all of the phases are open circuited to trip the circuit breaker. This reduces the tripping time and hence risk of damage to the electrical load. The circuit breaker includes a thermal trip unit and a phase sensitivity assembly that is interlocked with the bimetals included with the thermal unit. The phase sensitivity assembly includes one or more levers, responsive to the deflection of a bimetal corresponding to the open circuited phase resulting from cooling action of a bimetal relative to the other bimetals. The relative displacement of the cooling bimetal is used to either trip or reduce the tripping time of the circuit breaker.

15 Claims, 8 Drawing Sheets

PHASE SENSITIVITY

BACKGROUND OF THE INVENTION

Cross Reference to Related Applications

The invention disclosed herein relates to molded case circuit breakers. The following patent applications all relate to molded case circuit breakers and were filed on Aug. 1, 1988: Ser. No. 226,503, entitled CROSS-BAR ASSEMBLY, by Jere L. McKee, Lance Gula and Glenn R. Thomas; and Ser. No. 226,655, entitled COMBINATION BARRIER AND AUXILIARY CT BOARD, by Gregg Nissly, Allen B. Shimp and Lance Gula.

The following commonly assigned U.S. Pat. applications were filed on Oct. 12, 1988 and all relate to molded case circuit breakers: Ser. No. 256,881 entitled SCREW ADJUSTABLE CLINCH JOINT WITH BOSSES, by James N. Altenhof, Ronald W. Crookston, Walter V. Bratkowski, and J. Warren Barkell; Ser. No. 256,879 entitled TAPERED STATIONARY CONTACT LINE COPPER, by Ronald W. Crookston; and Alfred E. Maier; and Ser. No. 256,878, entitled TWO-PIECE CRADLE LATCH FOR CIRCUIT BREAKER, by Alfred E. Maier and William G. Eberts.

The following commonly assigned U.S. Pat. applications also relate to molded case circuit breakers: Ser. No. 260,848, filed on Oct. 21, 1988, entitled UNRIVETED UPPER LINK SECUREMENT, by Joseph Changle and Lance Gula. Ser. No. 07/331,769, filed on Apr. 3, 1989, entitled ARC RUNNER CONTAINMENT SUPPORT ASSEMBLY, by Charles Paton, Kurt Grunert and Glen Sisson; and Ser. No. 07/331,920, filed on Mar. 31, 1989, entitled EXTENDER SPRING FOR INCREASED MAGNETIC TRIP SETTINGS, by Kurt Grunert.

The following two commonly owned patent applications were filed on Apr. 25,1989: Ser. No. 07/343,047, entitled TWO-PIECE CRADLE LATCH, KEY BLOCKS AND SLOT MOTOR FOR CIRCUIT BREAKER, by Alfred E. Maier, William G. Eberts and Richard E. White and Ser. No. 07/342,820, entitled TWO-PIECE CRADLE LATCH, HANDLE BARRIER LOCKING INSERT AND COVER INTERLOCK FOR CIRCUIT BREAKER by A. D. Carothers, D. A. Parks, R. E. White and W. G. Eberts.

Commonly owned patent application Ser. No. 07/374,370 was filed on Jun. 30, 1989, entitled REVERSE SWITCHING MEANS FOR MOTOR OPERATOR, by Kurt Grunert and Charles Paton.

Commonly owned patent application Ser. No. 07/389,849 was filed on Aug. 14, 1989, entitled TRIP INTERLOCK DESIGN, by Kurt Grunert, Ronald Cheski, Robert Tedesco, Michael J. Whipple, Melvin A. Carrodus and James G. Maloney.

Commonly owned U.S. Pat. application Ser. No. 491,329 was filed on Mar. 9, 1990, entitled "PINNED SHUNT END EXPANSION JOINT", by Lance Gula and Roger W. Helms.

Lastly, commonly owned application Ser. No. 503,812, was filed on Apr. 31, 1990, entitled "CIRCUIT BREAKER POSITIVE OFF LINK", by David A. Parks, Yu Wei Chou and Thomas A. Whitaker.

1. Field of the Invention

This invention relates to molded case circuit breakers and more particularly to a multiphase molded case circuit breaker having a phase sensitivity assembly which either trips or reduces the tripping time of the circuit breaker any time an open circuit condition occurs in less than all of the phases in a multiphase electrical device connected to the circuit breaker.

2. Description of the Prior Art

Molded case circuit breakers are generally old and well-known in the art. Examples of such circuit breakers are disclosed in U.S. Pat. Nos. 4,489,295; 4,638,277; 4,656,444 and 4,679,018. Such circuit breakers are generally used to protect electrical circuitry from damage due to an overcurrent condition, such as an overload and a relatively high level short circuit condition. An overload condition is normally 200 to 300 percent of the nominal current rating of the circuit breaker. A high level short circuit condition can be 1000 percent or more of the nominal current rating of the circuit breaker.

Molded case circuit breakers generally include at least one pair of separable main contacts which may be operated manually by way of an operating handle, extending outwardly from the circuit breaker case, or automatically in response to an overload or a high level short circuit condition. In the manual mode and one automatic mode of operation, the separable main contacts are opened by an operating mechanism which, in turn, is actuated by either a trip unit in the automatic mode or the operating handle in the manual mode. In another automatic mode of operation, magnetic repulsion forces, generated between the stationary and movable main contacts during relatively high level overcurrent conditions can also cause the main contacts to be separated independently of the operating mechanism.

In the first mentioned automatic mode of operation, thermal magnetic trip units are used to sense an overcurrent condition. These thermal magnetic trip units are interlocked with the circuit breaker operating mechanism to cause the separable main contacts to be tripped during an overcurrent condition. More specifically, the thermal magnetic trip units are comprised of a thermal unit and a magnetic unit. The thermal unit consists of one or more bimetals which cause the circuit breaker to be tripped during an overload condition. The bimetals are generally disposed in series with a line conductor and thus are subjected to line current. During normal operating conditions, the bimetals are deflected by the line current flowing therethrough but not enough to cause a trip of the circuit breaker. During an overload condition, the bimetals are subjected to additional heat resulting from the increased current flow therethrough which causes additional deflection of the bimetals resulting in tripping of the circuit breaker.

The magnetic unit includes a magnetic core assembly and a movable armature. The movable armature is generally interlocked to trip the circuit breaker during relatively high level overcurrent conditions, such as a short circuit condition. More specifically, a generally U-shaped conductor is disposed in series with the line conductor and is disposed about a magnetic core forming a magnetic core assembly. A pivotally mounted armature is disposed at a predetermined air gap from the magnetic core assembly. When the electrical current through the U-shaped conductor becomes relatively high, such as during a short circuit condition, sufficient magnetic attraction forces are generated in the magnetic core assembly to attract the armature. Since the armature is interlocked with the operating mechanism, this action causes the circuit breaker to trip.

Various types of thermal magnetic trip units are known. In one type, the thermal magnetic unit is formed as a part of the circuit breaker. In another type, the thermal magnetic trip unit is interchangeable and is formed as a modular unit with a separate housing which can easily be inserted and removed from the circuit breaker as a unit.

Depending upon the type of electrical load to be protected, some trip units are provided with magnetic only trip units, such as in the case of electric arc welders. In other applications, a magnetic only trip unit is provided on the circuit breaker when the overload protection is provided in another device, such as a motor contactor which are generally provided with overload relays. However, for many electrical loads, such as electrical motors, both overload and short circuit protection is provided by the circuit breaker. Accordingly, both thermal and magnetic trip units, which may be adjustable, are provided on circuit breakers supplying such electrical loads. Examples of such adjustable thermal magnetic tripping units are disclosed in U.S. Pat. Nos. 4,691,182; 4,698,606 and 4,725,800, all assigned to the same assignee as the present invention and hereby incorporated by reference.

In multipole circuit breakers an overcurrent condition sensed by any pole will generally cause all the poles to be tripped. More specifically, on such multipole circuit breakers, such as three pole circuit breakers, separate thermal and magnetic trip units are provided for each pole. These thermal magnetic trip units are commonly interlocked with the operating mechanism to trip the circuit breaker for an overcurrent condition sensed by any pole. However, when the circuit breaker is connected to a dynamic load, such as an electrical motor, and one phase of the electrical load becomes open circuited, the trip unit and, specifically, the thermal unit may not respond quickly enough to prevent damage to the load. During such a condition, the electrical current in the remaining phases will gradually increase and eventually trip the circuit breaker but oftentimes not quickly enough to prevent damage to the electrical load. In addition to the expense of replacing the motor if it gets damaged, this condition can also result in incidental expenses associated with labor costs and downtime for replacement or repair of the damaged electrical load.

SUMMARY OF THE INVENTION

It is an object of the present invention to provide a molded case breaker which reduces the possibility of damage to a multiphase electrical load during a condition when less than all of the phases are open circuited during operation.

It is yet a further object of the present invention to provide means for detecting a condition where less than all of the phases of a multiphase electrical load are open circuited during operation.

It is yet a further object of the present invention to provide a thermal trip unit for a circuit breaker which shortens the tripping time of the circuit breaker during a condition when less than all of the phases of a multiphase electrical load are open circuited.

Briefly, the present invention relates to a phase sensitivity assembly for a multipole circuit breaker, for example, a three pole circuit breaker, which can detect when a multiphase electrical load, connected to the circuit breaker, experiences a condition where less than all of the phases are open circuited. The tripping time of the circuit breaker is reduced by the phase sensitivity assembly during this condition to reduce the risk of damage to the electrical load. The phase sensitivity assembly is interlocked with bimetals included with the thermal trip units and includes one or more levers, responsive to the cooling of the bimetals, representative of an open circuit condition for that pole. The deflection of the cooling bimetal relative to the bimetals for the other poles is used to reduce the tripping time of the circuit breaker during such a condition.

DESCRIPTION OF THE DRAWING

These and other objects and advantages of the present invention will become readily apparent upon consideration of the following detailed description and attached drawing, wherein:

FIGS. 6*a*–6*e* are operational views of one embodiment of the present invention illustrated in FIGS. 1–5;

DETAILED DESCRIPTION

Figure 1:
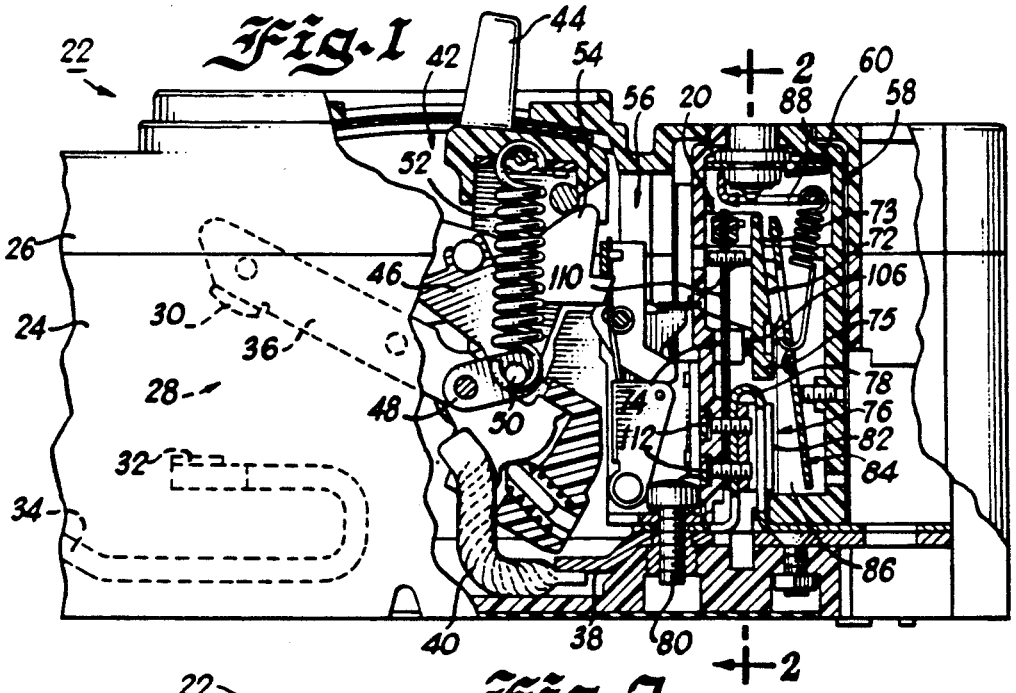
FIG. 1 is a side elevational view of a molded circuit breaker incorporating the principles of the present invention, partially broken away.

The phase sensitivity assembly in accordance with the present invention is generally identified with the reference numeral 20. It should be understood by those of ordinary skill in the art that the principles of the phase sensitivity assembly 20 in accordance with the present invention will apply equally to interchangeable type thermal magnetic trip units and non-interchangeable type thermal magnetic trip units. For illustration purposes only, the following description and the drawings are shown with an interchangeable trip unit having both an adjustable magnetic unit and an adjustable thermal unit. It should also be understood by those of ordinary skill in the art that the principles of invention are equally applicable to thermal magnetic trip units having either adjustable or non-adjustable magnetic and/or thermal units. It should also be clear that the principles of the present invention apply equally to various multipole circuit breakers, such as two pole and three pole circuit breakers.

Referring to the drawings, and in particular, FIGS. 1–6, a molded case circuit breaker 22 is illustrated having a base 24 and a coextensive cover 26. Disposed within the base 24 are a plurality of pairs of separable main contacts 28 which include an upper main contact 30 and a lower main contact 32. The lower main contact 32 is carried by a rigid lower main contact arm 34. The lower main contact arm 34 forms a portion of a line side conductor. The upper main contact 30 is carried by a pivotally mounted upper contact arm 36 and is serially connected to a load side conductor 38 by way of a flexible shunt 40.

The upper main contact arm 36 is mechanically interlocked with an operating mechanism 42 and an operating handle 44. The operating mechanism 42 is described in detail in U.S. Pat. No. 3,797,009, assigned to the same assignee as the assignee of the present invention and hereby incorporated by reference. The operating mechanism 42 is an overcenter toggle mechanism which includes a pair of upper toggle links 46 and a pair of lower toggle links 48. The upper and lower toggle links 46 and 48 are pivotally connected together at a knee joint 50. An operating spring 52 is disposed between the knee joint 50 and the operating handle 44.

The operating handle 44 is carried by a cradle 54 and latched by a latch assembly 56 during normal operation. The latch assembly 56 may form a portion of an interchangeable type thermal magnetic trip unit assembly 58 as shown. For circuit breakers 22 with non-interchangeable thermal magnetic trip units 58, the latch assembly 56 may be separate therefrom but functions in a similar manner.

Figure 2:
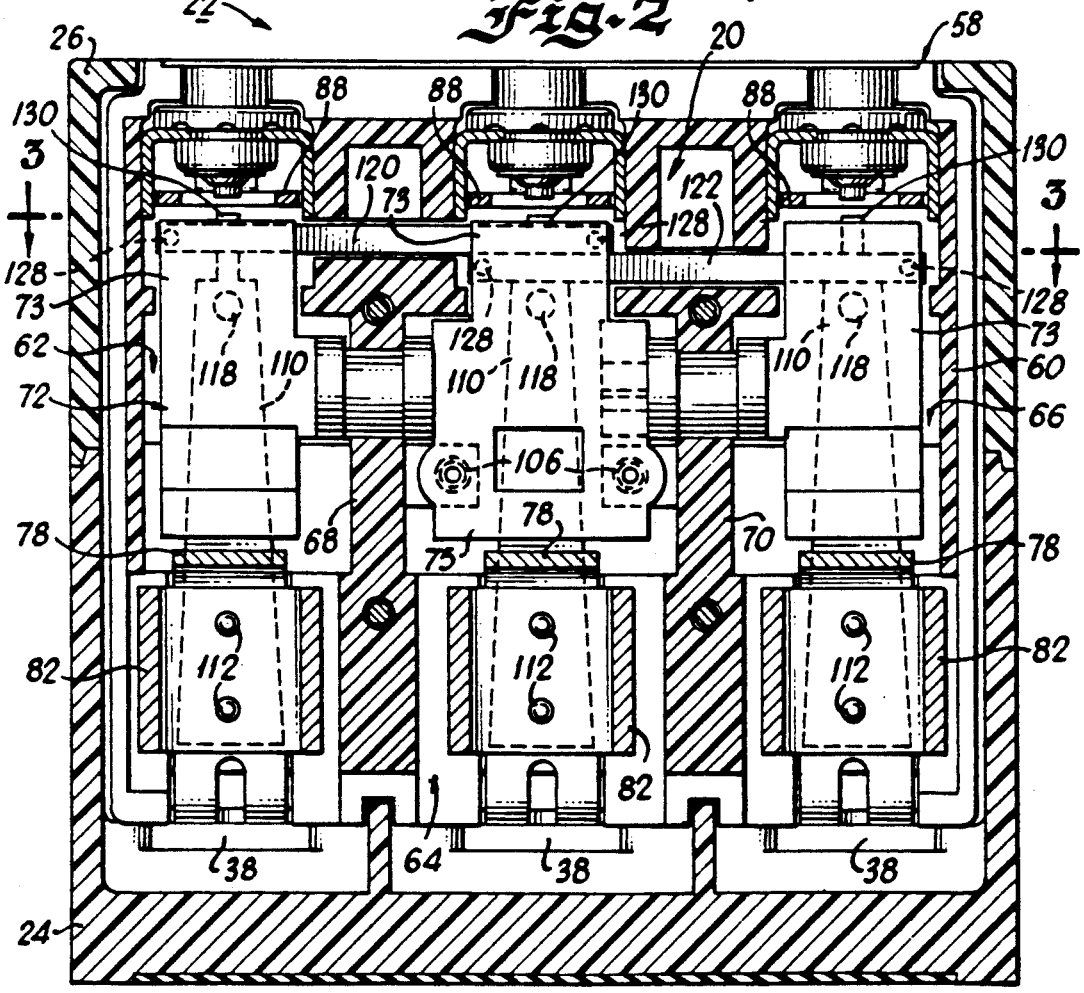
FIG. 2 is a cross-sectional view taken along the line 2—2 of FIG. 1.
Figure 3:
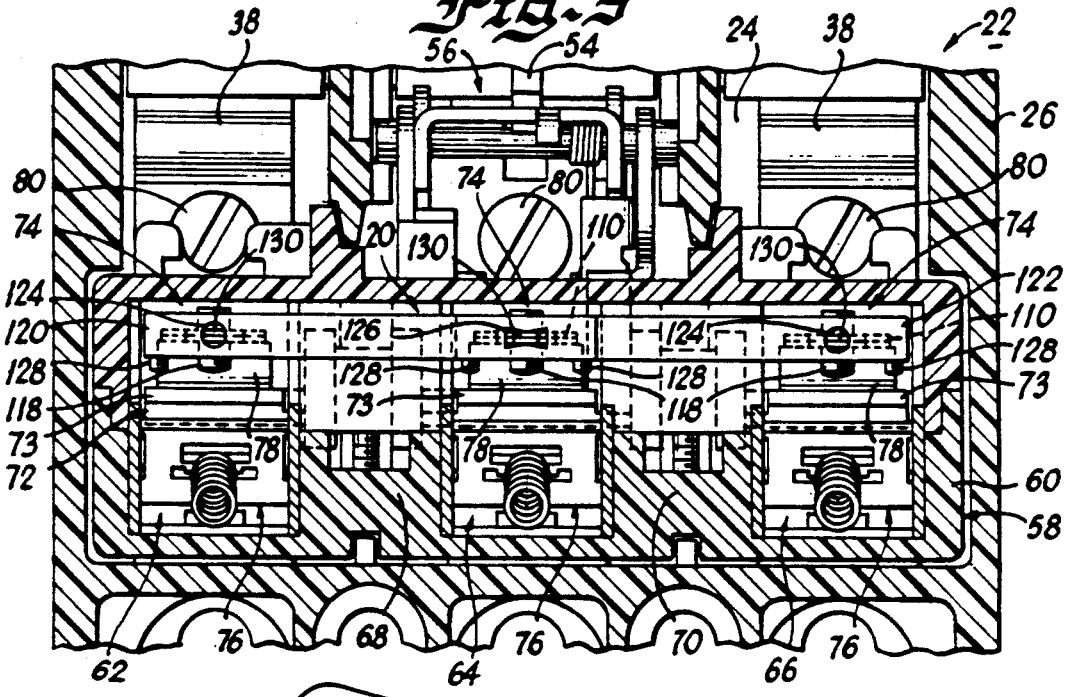
FIG. 3 is a plan sectional view taken along the line 3—3 of FIG. 2.

A detailed description of the thermal magnetic trip unit 58 is illustrated and disclosed in U.S. Pat. Nos. 4,691,182 and 4,698,606 assigned to the same assignee as the assignee in the present invention and hereby incorporated by reference. These thermal magnetic trip units 58 are disposed in a separate housing 60 wherein each pole of the trip unit 58 is compartmentalized. For example, as shown in FIG. 2, a three pole thermal magnetic trip unit 58 is shown having compartments 62, 64 and 66; one compartment for each of the respective poles. Two interior sidewalls 68 and 70 are formed in the housing 60 to define the compartments 62, 64 and 66. A trip bar 72, common to all three compartments 62, 64 and 66, is journalled in the sidewalls 68 and 70. Operation of any pole of the thermal magnetic trip unit 58 will cause the trip bar 72 to rotate which, in turn, will release the latch assembly 56. Release of the latch assembly 56 causes the main contacts 28 to open under the influence of the operating spring 52.

The thermal magnetic trip unit 58 includes a thermal unit 74 and a magnetic unit 76. The magnetic unit 76 includes an inverted U-shaped conductor 78, serially connected to the load side conductor 38 by way of fasteners 80. The inverted U-shaped conductor 78 is disposed about a magnetic core 82 forming a magnetic core assembly or electromagnet. An armature assembly 84 is disposed at a predetermined air gap 86 (FIG. 1) from the U-shaped conductor 78. The armature assembly 84 includes a pivotally mounted armature lever 88 and an adjustment assembly 90. The armature assembly 84 and the adjustment assembly 90 are described in detail in U.S. Pat. No. 4,691,182, hereby incorporated by reference.

The thermal unit 74 may include one bimetal 110 per pole. The bimetals 110 are attached at one end to the magnetic core 82 and the U-shaped conductor 78 with a plurality of fasteners 112. More specifically, the bimetals 110 are provided with one or more apertures 114 at one end. These apertures 114 are aligned with apertures 116, provided in the U-shaped conductor 78. The fasteners 112 are inserted through the aligned apertures 114 and 116 to secure the U-shaped conductors 78 and the bimetals 110 to the magnetic core 82.

The bimetals 110 each consist of two strips of metal bonded together. Each strip is chosen with a different thermal rate of heat expansion. Since the bimetals 110 are attached to the U-shaped conductor 78 they will be subject to load current. The heat resulting from the load current will cause the bimetals 110 to deflect a predetermined amount during normal operating conditions but not enough to engage the trip bar 72. During an overload condition, the bimetals 110 will generally deflect an additional amount to engage the trip bar 72. More specifically, during such a condition, the bimetals 110 are adapted to engage upstanding ear portions 73, integrally formed on the trip bar 72.

The orientation of the metal strips determines the direction of the deflection of the bimetals 110. As shown in FIG. 1, the metal strips are oriented to cause the bimetals 110 to deflect to the right. Thus, during an overload condition, the bimetals 110 will deflect and engage the upstanding ear portions 73 to cause the trip bar 72 to rotate in a clockwise direction (FIG. 1) and oppose the force of biasing springs 106, disposed between the housing 60 and depending ear portions 75.

The air gap 86 between the bimetal 110 and the trip bar 72 can be adjusted by way of adjustment screws 118. The adjustment screws 118 are accessible from the outside of the housing 60 and disposed on one end of the bimetal 110.

In known circuit breakers, during a condition when one phase of an electrical load attached to the circuit breaker 221 is open circuited, the bimetal 110 corresponding to that phase will cool and deflect back to a cold position (e.g., a position when there is no electrical current flowing through the bimetal 110). When a dynamic electrical load, such as a motor, is connected to the circuit breaker 22, opening circuiting of one phase (or less than all phases) will cause the electrical current in the remaining phases to increase. This increased electrical current in turn will cause the other bimetals 110 to eventually trip the circuit breaker 22. However, the time period for tripping the circuit breaker 22 during such a condition may be too long to prevent damage to the motor.

Figure 12:
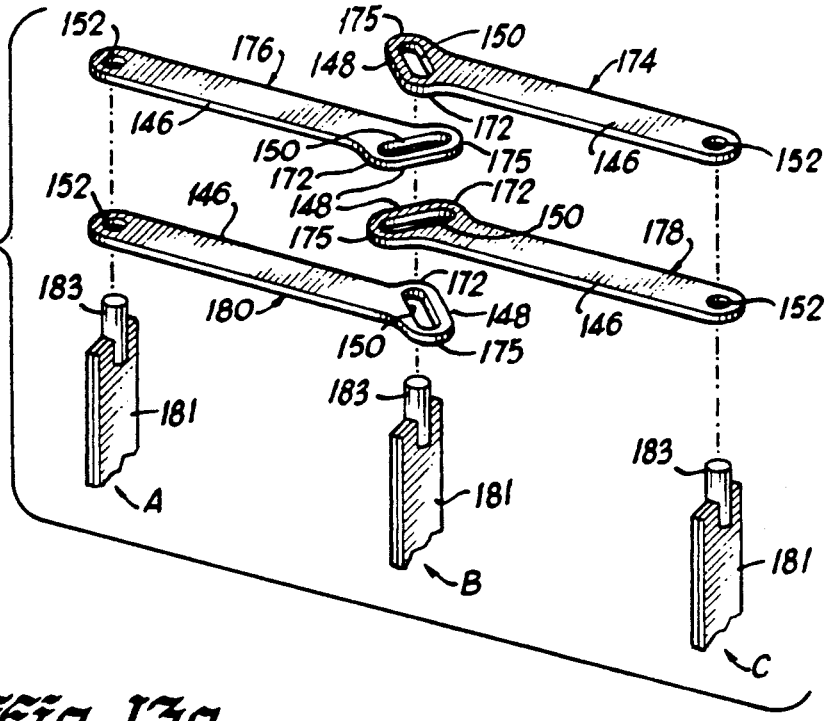
FIG. 12 is an exploded perspective view of another embodiment of the present invention.

An important aspect of the present invention relates to utilizing the displacement of a bimetal 110 that has cooled due to open circuiting to reduce the time period for tripping to occur. Each of the embodiments relies upon the relative displacement of a cooling bimetal 110 relative to the remaining bimetals 110 to shorten the tripping time of the circuit breaker 22 during this condition. The first embodiment is illustrated in FIGS. 1–6. The second embodiment is shown in FIGS. 7–11. The third embodiment is shown in FIGS. 12 and 13. The fourth embodiment is shown in FIGS. 14–17.

Referring to the first embodiment, two phase sensitivity levers 120 and 122 are provided. The phase sensitivity levers 120 and 122 are formed as elongated members with an aperture 124 disposed adjacent one end and a second aperture 126 disposed adjacent the other end. Each phase sensitivity lever 120 and 122 is coupled to the bimetals 110 corresponding to a center pole and an outside pole. For example, the phase sensitivity lever 120 may be coupled to the bimetals 110 corresponding to the A phase and the B phase while the phase sensitivity lever 122 may be coupled to the bimetals 110 corresponding to the B phase and the C phase.

Adjustment screws 128 are provided at each end of the phase sensitivity levers 120 and 122. These adjustment screws 128 can be adjusted to decrease the distance to the upstanding ear portions 73 on the trip bar 72.

Figure 4:
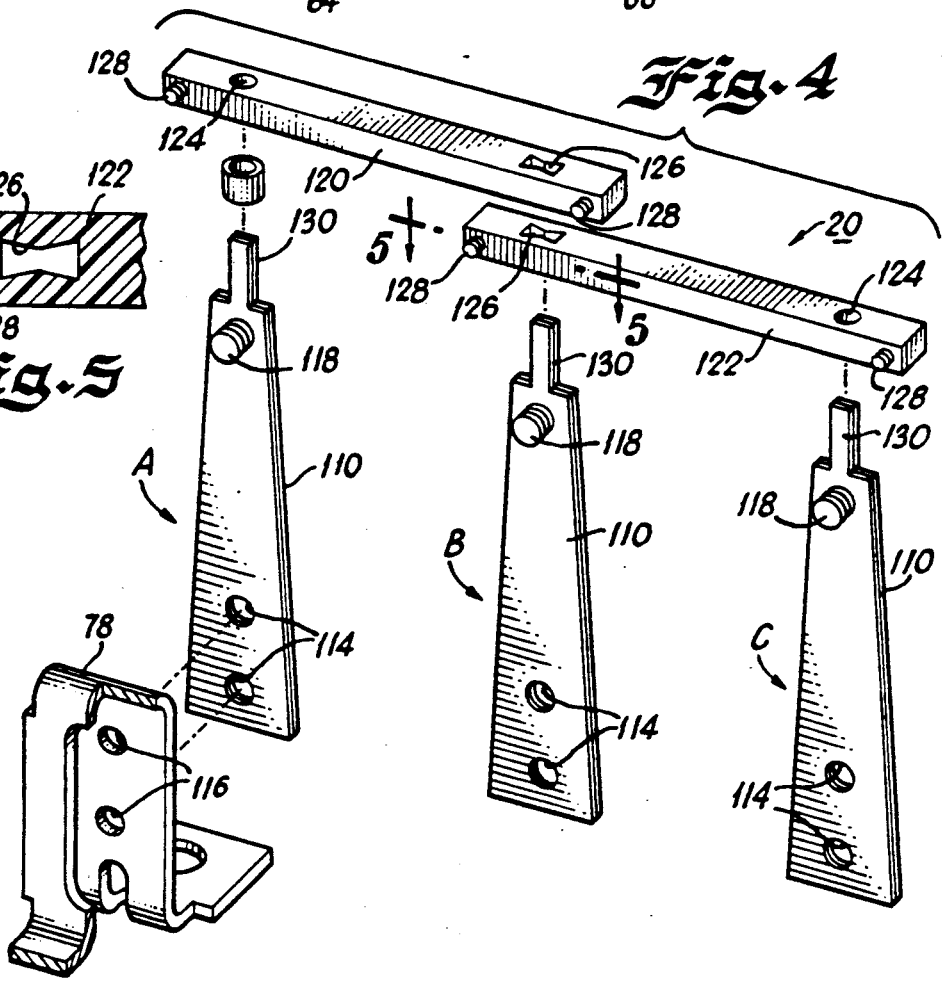
FIG. 4 is an exploded perspective view of some components of the phase sensitivity assembly in accordance with the present invention.
Figure 5:
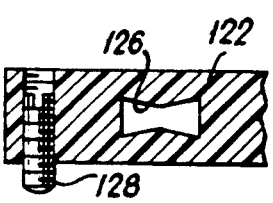
FIG. 5 is an enlarged fragmentary cross-sectional view along line 5—5 of FIG. 4.
Figure 5A:
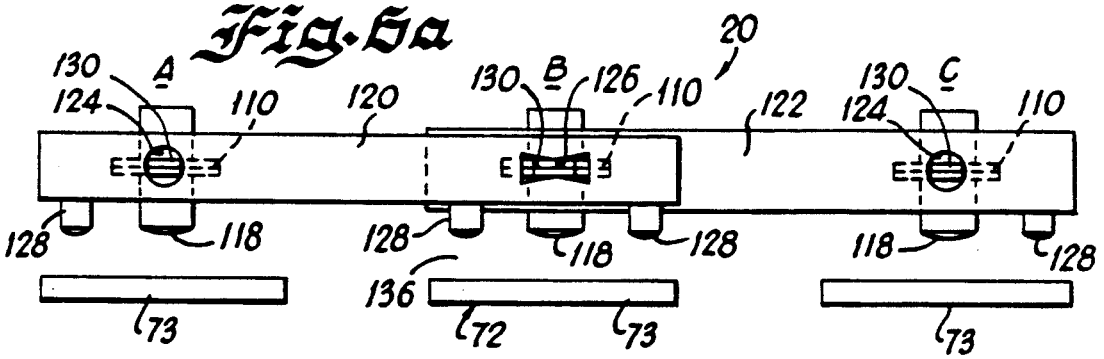
Figure 5B:
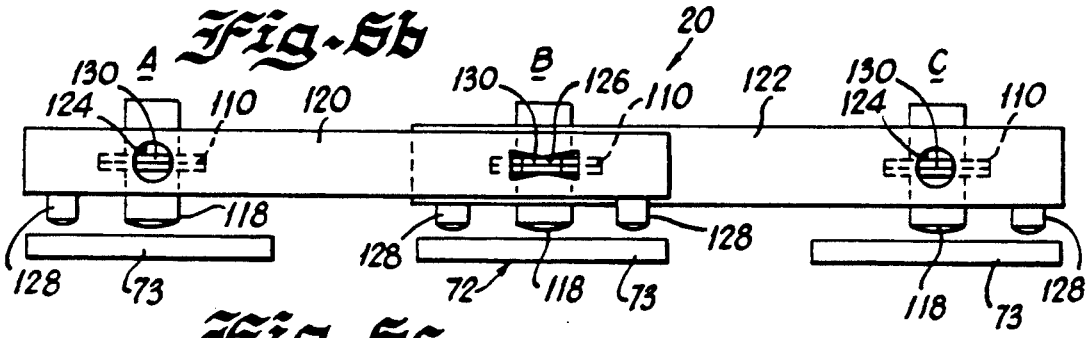
Figure 5C:
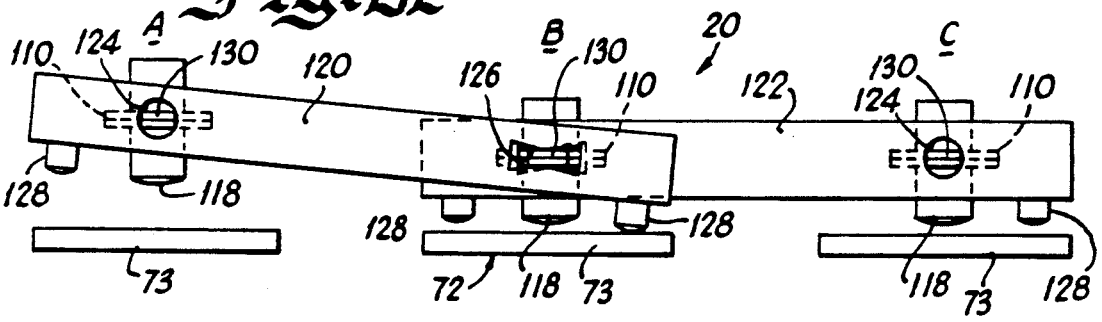
Figure 5D:
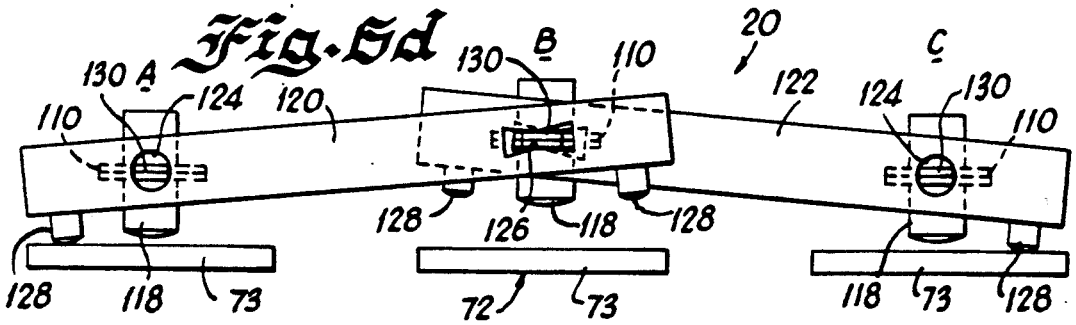
Figure 5E:
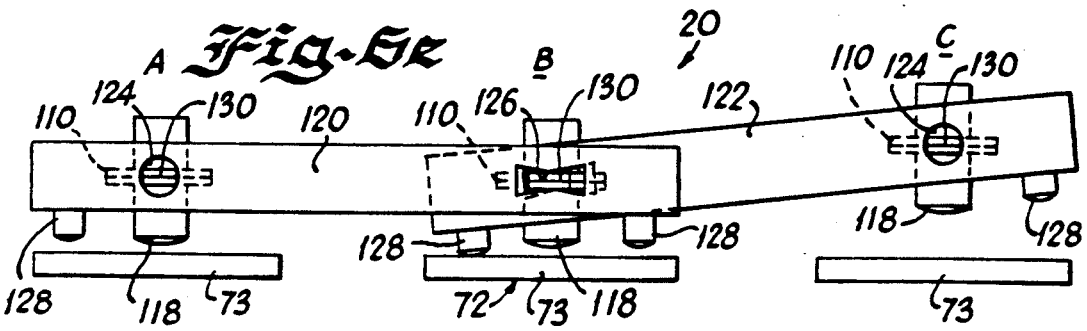
Figure 7:
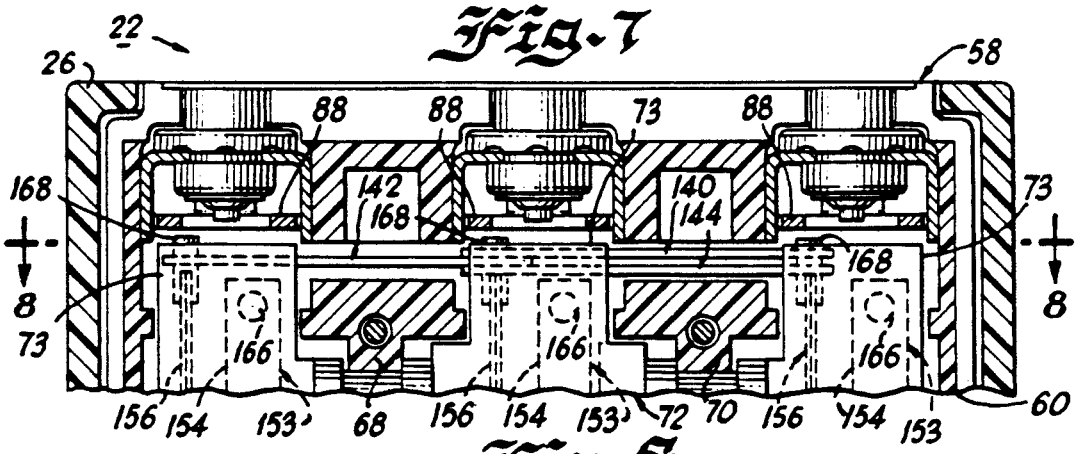
FIG. 7 is a sectional view of an alternate embodiment of the phase sensitivity assembly in accordance with the present invention, similar to FIG. 2.

Apertures 124 and 126 receive finger portions 130 extending from the free end of the bimetals 110. As best shown in FIG. 4, the aperture 124 in the phase sensitivity lever 120 is adapted to receive the extending finger portion 130 of an outside pole bimetal 110 while the aperture 124 on the phase sensitivity lever 122 is adapted to receive the extending finger portion 130 of the other outside pole bimetal 110. The apertures 126 in the phase sensitivity levers 120 and 122 are aligned to receive the extending finger portions 130 of the center pole bimetal 110.

FIG. 6 illustrates the orientation of the phase sensitivity levers 120 and 122 with respect to the trip bar 72 during various conditions. More specifically, in FIG. 6*a*, the phase levers 120 and 122 are shown in a cold condition (e.g., a condition corresponding to no electrical current flow through the bimetal) at a predetermined air gap 136 between the adjustment screws 118 and the upstanding ear portions 73 of the trip bar 72. In the running condition, as illustrated in FIG. 6*b*, the deflection of the bimetals 110 causes the phase sensitivity levers 120 and 122 to be advanced toward the trip bar 72 but not enough to engage it or cause rotation.

FIGS. 6*c*, 6*d* and 6*e* illustrate the positions of the phase sensitivity levers 120 and 122 when various phases of an electrical load connected to the circuit breaker 22 are open circuited. More specifically, FIG. 6*c* illustrates the condition when the outside pole corresponding to the A phase is open circuited. In this condition, the phase sensitivity lever 122 remains in the same position initially as the running condition illustrated in FIG. 6*b*. However, the phase sensitivity lever 120 is rotated in a clockwise direction due to the cooling action and resulting deflection of the bimetal 110 corresponding to the A-phase. This cooling action causes the adjustment screw 128 disposed adjacent the B-phase bimetal 110 to move toward the upstanding ear portion 73 of the trip bar 72 as shown in FIG. 6*c*. This action reduces the distance that the B phase bimetal 110 will need to travel to trip the trip bar 72 and hence reduces the tripping time of the circuit breaker 22.

FIG. 6*d* illustrates the position of the phase sensitivity levers 120 and 122 when the B phase or center pole is open circuited. FIG. 6*e* illustrates the position of the phase sensitivity levers 120 and 122 when the C-phase outside pole is open circuited. For these conditions, the operation of the phase sensitivity levers 120 and 122 is similar to that described above.

An alternate embodiment of the invention is illustrated in FIGS. 7–11. In this embodiment three phase sensitivity levers 140, 142 and 144 are utilized. Each of formed as an elongated member 146 with a depending boot portion 148 having an angled slot 150. An aperture 152 is provided in the opposite end of the elongated member 146.

Figure 9:
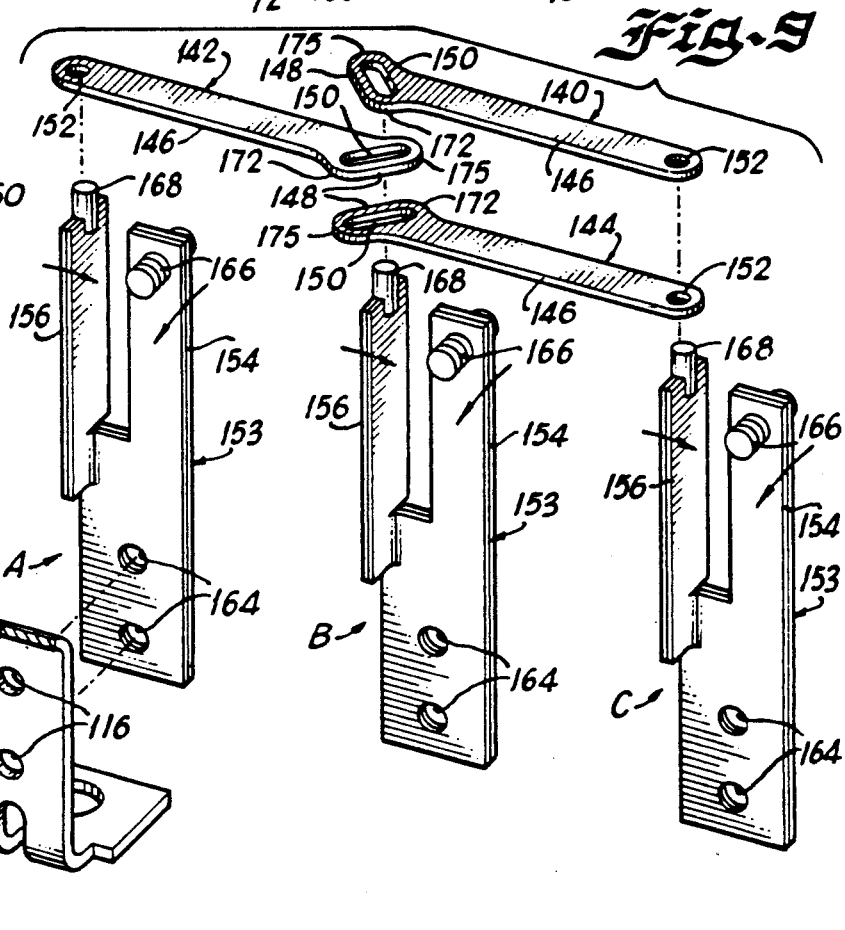
FIG. 9 is an exploded perspective view of some components of an alternate embodiment of the present invention.

This embodiment utilizes a bimetal assembly 153 having a primary bimetal 154 and a secondary bimetal 156. More specifically as best shown in FIG. 9, the primary 154 and secondary 156 bimetals are disposed generally perpendicular to each other. The bimetal assembly 153 may be either integrally formed as shown in FIG. 9 or formed separately as an assembly 157 from a rigid heat transfer bracket 159 and separate bimetals 160 and 162. It should be appreciated by those of ordinary skill in the art that either type of bimetal assembly 153 or 157 will work with the phase sensitivity levers 140, 142 and 144 in accordance with the present invention.

As shown, the bimetal assemblies 153 and 157 are provided with a plurality of apertures 164 for attachment to the U-shaped conductor 78. The primary bimetal 154 may include an adjustment screw 166 to adjust the air gap of the primary bimetal 154 relative to the upstanding ears 73 on the trip bar 72.

The primary bimetals 154 are used during normal operation to trip the circuit breaker 22 when an overload condition exists in any one of the poles. The secondary bimetals 156 are used in conjunction with the phase sensitivity levers 140, 142 and 144 for a condition when one phase (or less than all phases) of an electrical load connected to the circuit breaker 22 is open circuited.

The direction of deflection of the primary bimetals 154 and the secondary bimetals 156 is as shown by the arrows in FIG. 9. As heretofore discussed, the direction of deflection is controlled by the orientation of the metallic strips forming the bimetals.

Each of the secondary bimetals 156 includes an upwardly extending post 168 disposed on the free ends. These posts 168 are adapted to be received in the apertures 152 and the angled slots 150.

Figure 8:
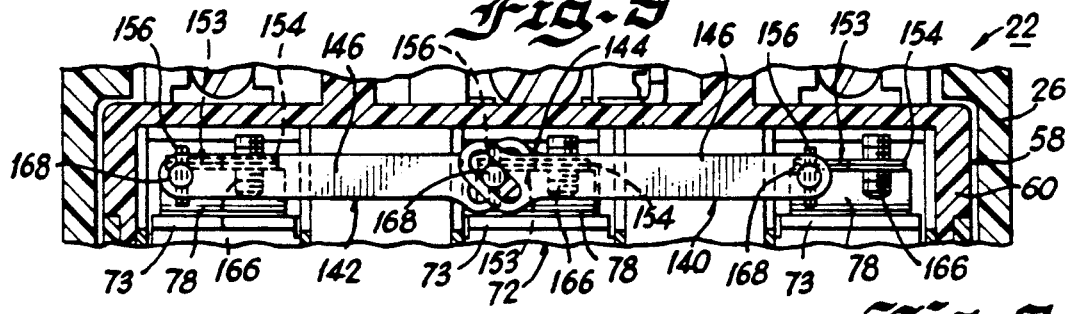
FIG. 8 is a plan section view along the line 8—8 of FIG. 7.
Figure 11:
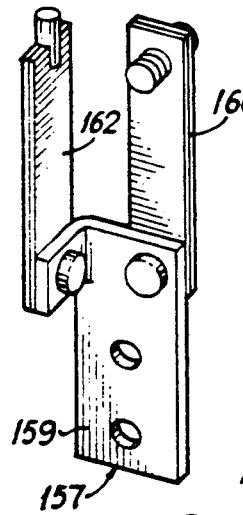
FIG. 11 is a perspective view of an alternate bimetal construction which may be utilized in the present invention.
Figure 10A:
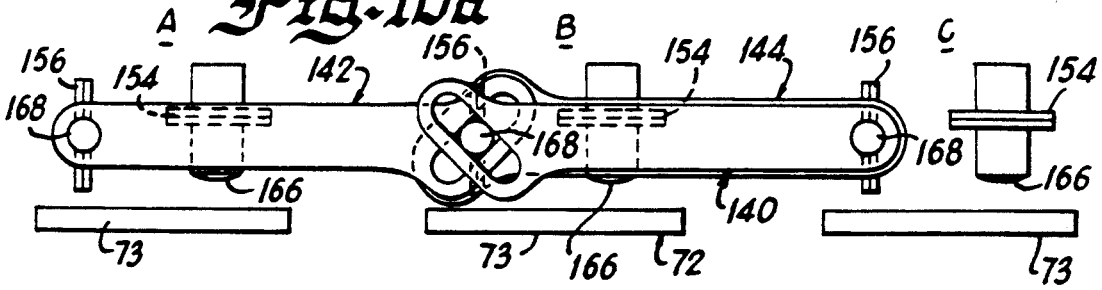
FIGS. 10*a*–10*e* are operational views of the present invention illustrated in FIGS. 7–9.
Figure 10B:
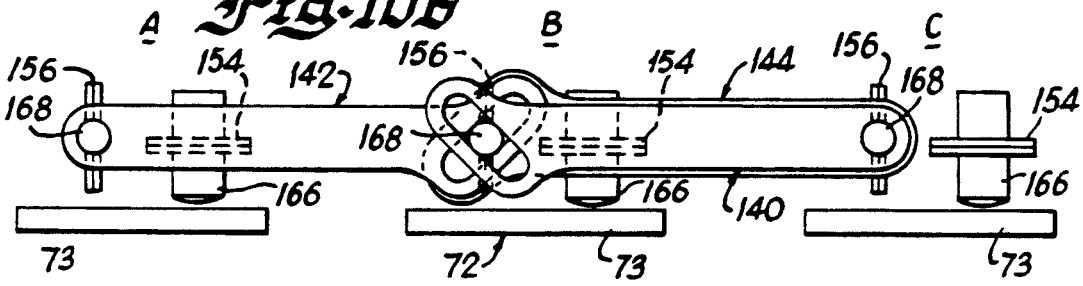

As best shown in FIG. 8, heel portions 172 and toe portions 175, are used to trip the trip bar 72. The phase sensitivity levers 140, 142 and 144 are aligned as shown in FIG. 10*a* in a cold condition when there is no current flowing through any of the secondary bimetals 156. In FIG. 10*b*, nominal electrical current flowing through the U-shaped conductor 78 causes heating of the bimetal assembly 153 resulting in deflection of the primary bimetal 154 and the secondary bimetal 156 as shown.

Figure 10C:
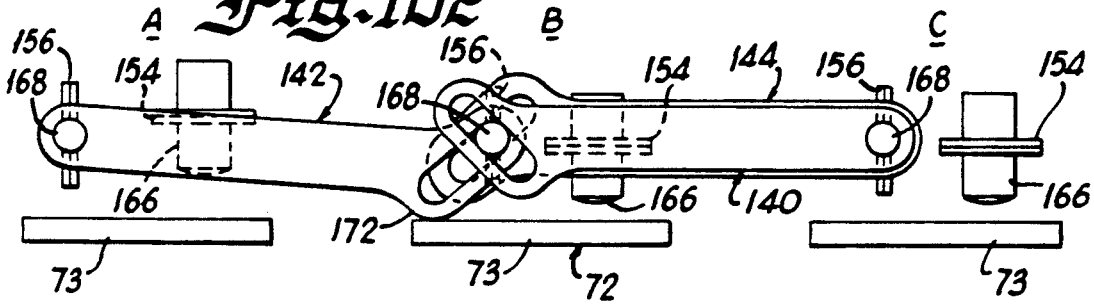
Figure 10D:
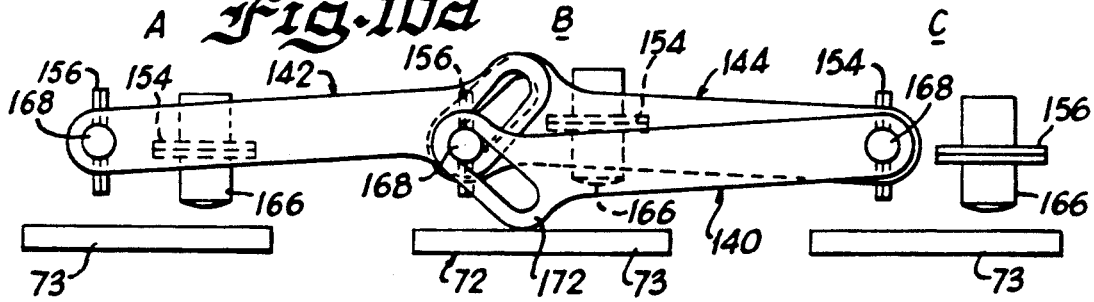
Figure 10E:
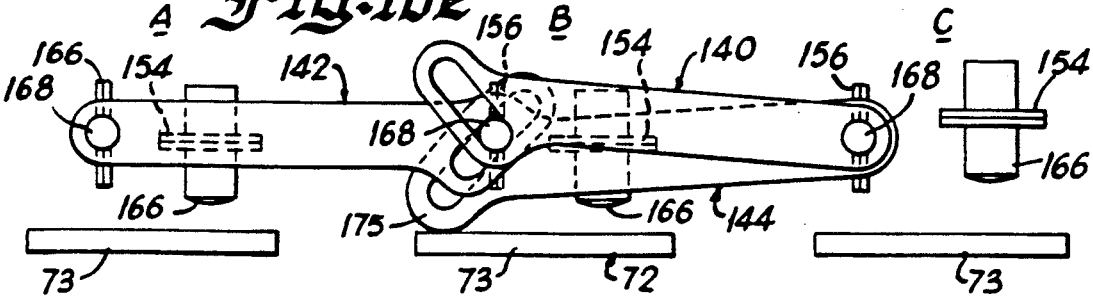

FIGS. 10*c*, 10*d* and 10*e* illustrate the positions of the various phase sensitivity levers 140, 142 and 144 when various phases are subject to an open circuit condition. More specifically, FIG. 10*c* illustrates the condition when the outside pole corresponding to the A-phase is open circuited. In this condition, the phase sensitivity lever 142 is deflected to the left as shown as a result of the cooling of the secondary bimetal 156 for the A-phase. When the A phase secondary bimetal 156 returns to its cooled position, it pulls phase sensitivity lever 142 to the left and in so doing, it rotates this lever 142 so that the heel portion 172 of that lever 142 engages and trips the upstanding ear portion 73 of the trip bar 72.

FIG. 10*d* illustrates a condition when the B-phase secondary bimetal 156 cools as a result of an open circuit. In this condition the phase sensitivity lever 140 rotates counterclockwise until its heel portion 172 engages and trips the upstanding ear 73 of the trip bar 72.

FIG. 10*e* illustrates a condition when the C-phase is open circuited. In this condition, phase sensitivity lever 144 is rotated counterclockwise so that its toe portion 150 engages and trips the upstanding ear portion 73.

An alternate embodiment of the invention is shown in FIGS. 12 and 13 where four phase sensitivity levers 174, 176, 178 and 180 are utilized. These phase sensitivity levers 174, 176, 178 and 180 are similar to the phase sensitivity levers 142, 144 and 146 as described above. However, in this embodiment, only one set of bimetals 181 is required having extending posts 183 formed on one end, similar to the secondary bimetals 156 illustrated in FIG. 12.

Figure 13A:
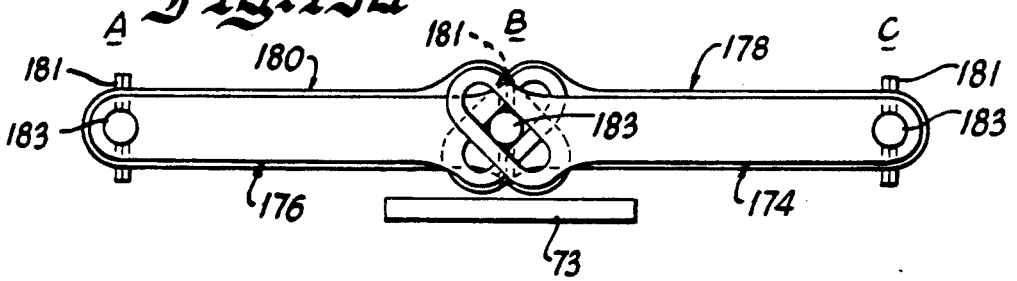
FIGS. 13*a*–13*c* are operational views of the present invention illustrated in FIG. 12.

During a normal running condition when nominal electrical current is flowing through all three poles, the bimetals 181 are deflected to the right as shown in FIG. 13*a*. In this position, heel portions 172 formed on the phase sensitivity levers 174, 176, 178 and 180 are disposed adjacent the upstanding ear portions 73 of the trip bar 72.

Figure 13B:
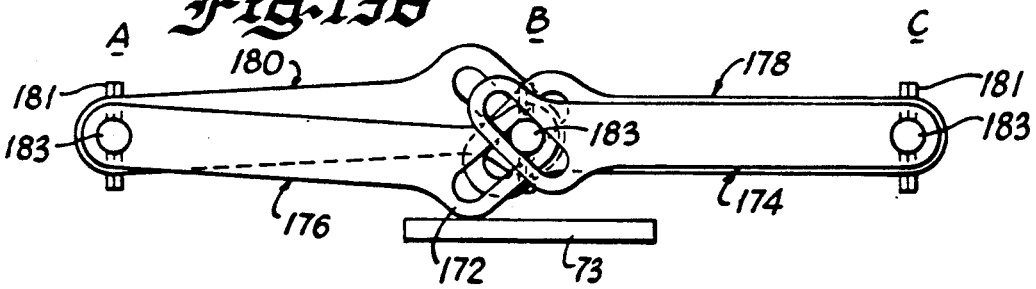

When an outside pole, such as the A phase outside pole, becomes open circuited as shown in FIG. 13*b*, the A phase bimetal 181 cools. This action results in a deflection of the A phase bimetal 181 to the left as shown. This causes the phase sensitivity levers 176 and 180 to be moved to the left. More specifically, due to the angled slot 150, the phase sensitivity lever 176 is moved downwardly while the phase sensitivity lever 180 is moved upwardly in this condition. This action results in the heel portion 172 of the phase sensitivity lever 176 engaging an upstanding ear portion 73 of the trip bar 72. Since electrical current will still be flowing through the B and C phase bimetals 181, the position of these bimetals will initially remain the same as shown in FIGS. 13*a* and 13*b*. Open circuiting of the B and C phases operates in a manner similar to that described above.

Figure 13C:
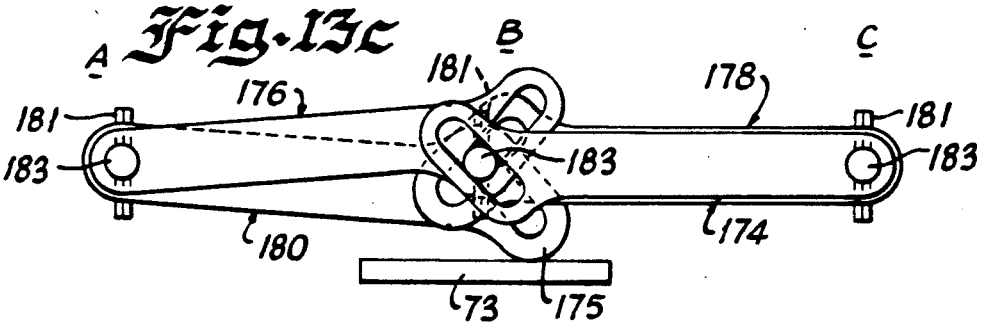
Figure 14:
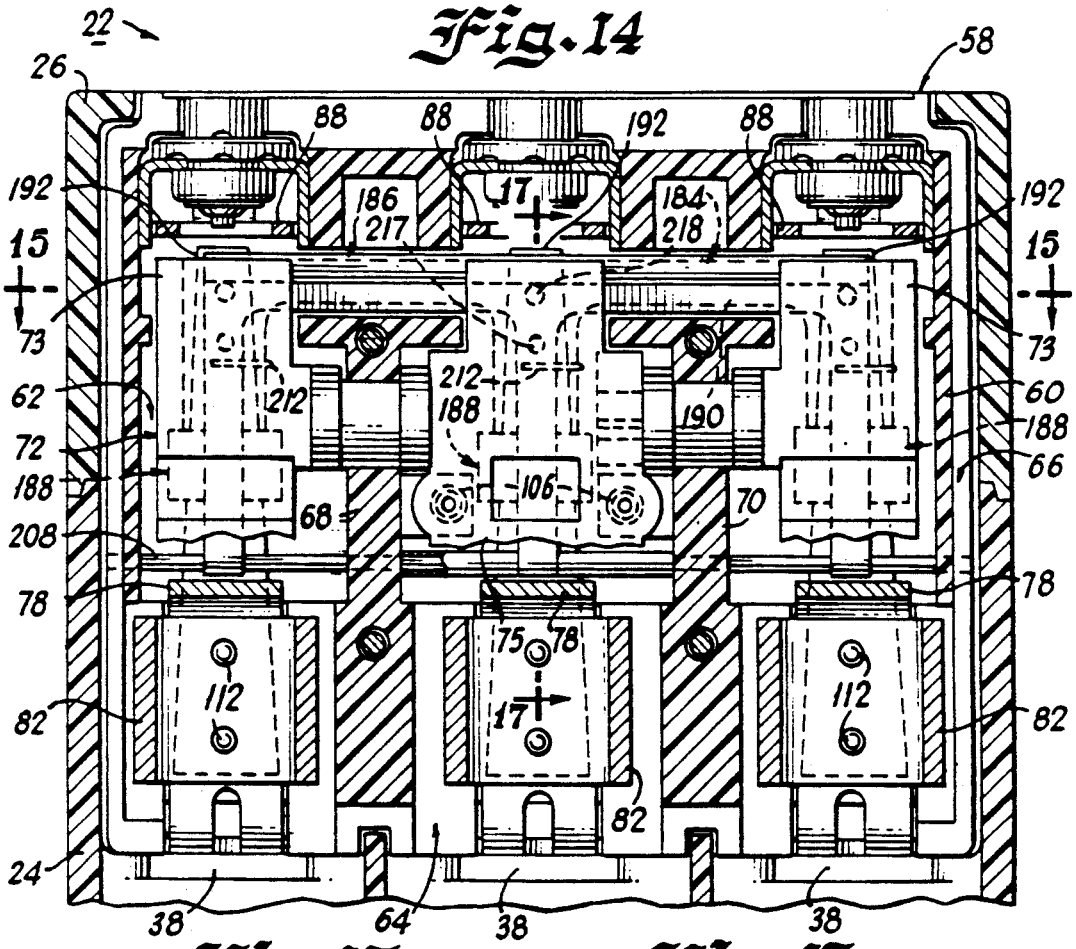
FIG. 14 is a sectional view similar to FIGS. 2 and 7 of another alternate embodiment of the present invention.

FIG. 13*c* illustrates a condition where all three phases are connected and an overload exists on the A phase. During this condition, the A phase bimetal 181 is deflected to the right as a result of the overload on that phase. This causes the phase sensitivity lever 176 to move upwardly and the phase sensitivity lever 180 to move downwardly. The downward movement of the phase sensitivity lever 180 causes the trip bar 72 to be tripped by the toe portion 175 of that lever 180.

In another alternate embodiment of the invention illustrated in FIGS. 14–17, a phase sensitivity lever 184 is utilized, common to all three poles. In this embodiment, open circuiting of any one phase causes movement of the phase sensitivity lever 184 which, in turn, causes movement of a trip lever 186. The phase sensitivity lever 184 and the trip lever 186 are operated by primary bimetals 192.

The trip lever 186 may be formed in one-piece, common to all three phases, defining a generally E-shaped member. The phase sensitivity lever 184 consists of three bell crank portions 188 all joined together by a common member 190.

Each bell crank portion 188 includes a pair of spaced apart arm portions 196. The arm portions 196 include a pair of aligned apertures 198, adapted to be aligned with apertures 200 provided in the trip lever 186. A pin 202 is received in the apertures 198 and 200 to form a floating pivotal connection between the bell crank portions 188 and the arm portions 196.

Disposed adjacent the apertures 200 in the arm portions 196 of the trip lever 186 are apertures 206. These apertures 206 are adapted to receive a pin 208 to provide a fixed pivotal connection between the trip lever 186 and internal sidewalls 68 and 70 formed in the circuit breaker base 24.

Figure 17:
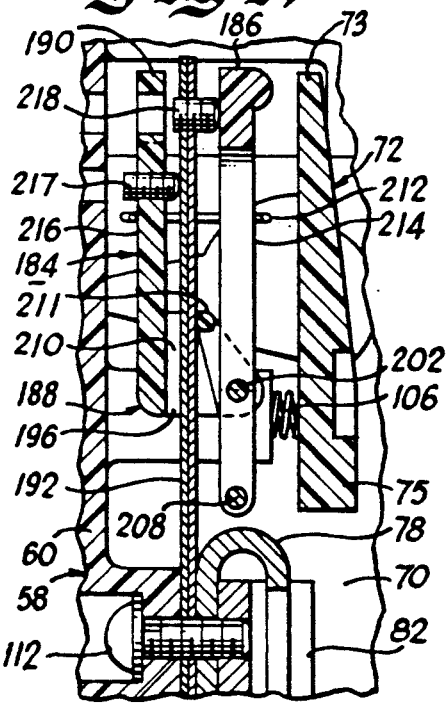
FIG. 17 is a cross-sectional view taken along line 17—17 of FIG. 14.
Figure 15:
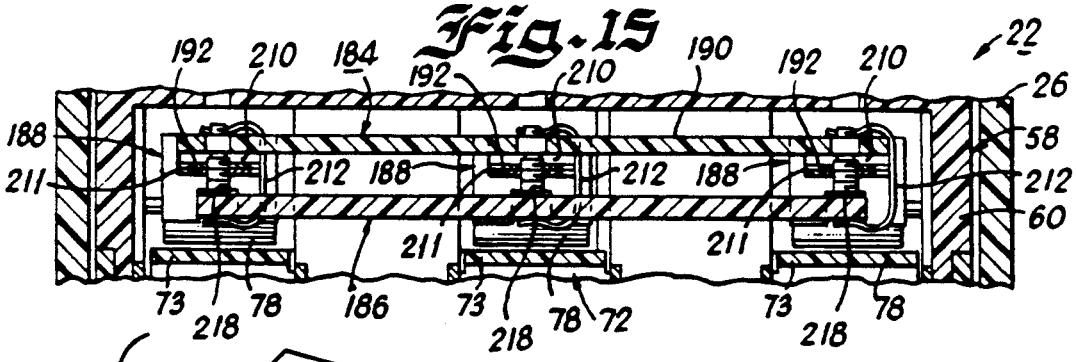
FIG. 15 is a plan sectional view taken along the line 15—15 of FIG. 14.
Figure 16:
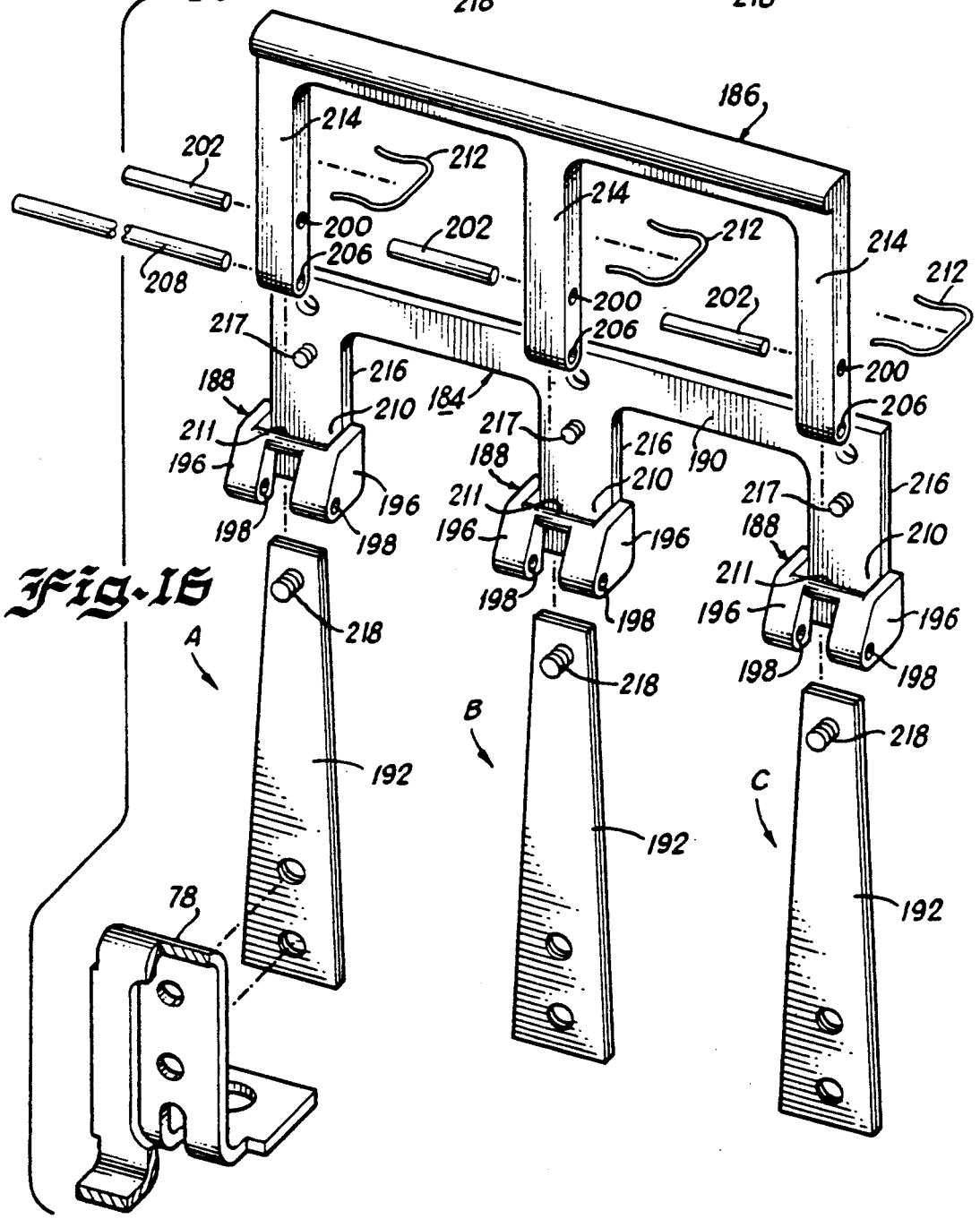
FIG. 16 is an exploded perspective view of the embodiment illustrated in FIGS. 14 and 15.

The bell crank portions 188 also include apertures 210 for receiving the primary bimetals 192 to allow them to be positioned therein, as best shown in FIG. 17. A spring 212 is disposed between a surface 214 on the trip lever 186 and a surface 216 on the phase sensitivity lever 184 as shown in FIG. 15. The spring 212 biases the phase sensitivity lever 184 toward the trip lever 186.

Adjustment screws 217 may be provided on the phase sensitivity lever 184 to allow adjustment relative to the primary bimetals 192. Additional adjustment screws 218 may be provided on the primary bimetals 192 to provide adjustment between the primary bimetals 192 and the trip lever 186.

Figure 17A:
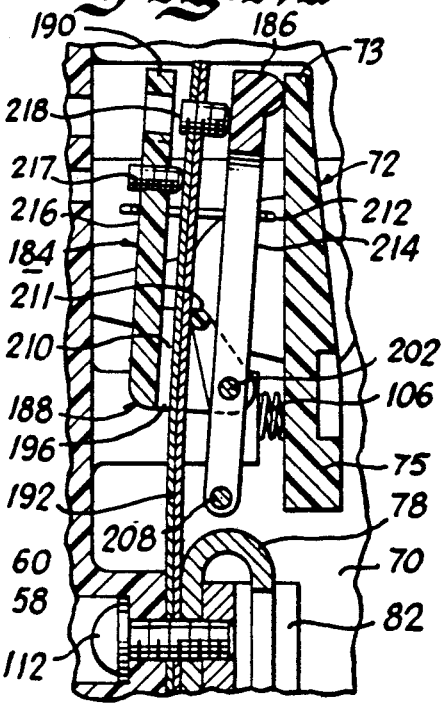
FIG. 17*a* is an operational view showing an alternate position of the components illustrated in FIG. 17.

FIGS. 17 and 17*a* illustrate the operation of the phase sensitivity lever 184 and the trip lever 186. FIG. 17 illustrates the position of the components in a cold condition (e.g., a condition where no electrical current is flowing through the bimetal 192) while FIG. 17*a* illustrates the position of the components in a running condition. When any one of the poles are open circuited, the primary bimetal 192 for that pole cools and moves to the left (FIG. 17). This cooling action of the primary bimetal 192 causes the phase sensitivity lever 184 to pivot about a nose portion 211 in a counterclockwise direction. This pivotal movement of the phase sensitivity lever 184 causes the pivot 202 between the trip lever 186 and the phase sensitivity lever 184 to move to the right. Since the trip lever 186 has a fixed pivot 208 at one end, this action causes the trip lever 186 to rotate in a clockwise direction. This rotation of the trip lever 186 moves the trip lever 186 either closer to the trip bar 72 or actually trips it.

Obviously, many modifications and variations of the present invention are possible in light of the above teachings. Thus, it is understood that within the scope of the appended claims, the invention may be practiced otherwise than as specifically designated above.

What is claimed and desired to be secured by a Letters Patent of the United States is:

1. A multipole molded case circuit breaker comprising:

a base;

a plurality of pairs of separable main contacts disposed in said base;

means for opening said pairs of separable main contacts including a trip bar;

means for detecting an open circuit condition in an electrical load connected to said circuit breaker including means for interfacing said detecting means with said opening means which includes one or more movably mounted members disposed a predetermined distance from said trip bar during normal conditions adapted to engage said trip bar during an open circuit condition; and wherein said detecting means includes a primary bimetal and a secondary bimetal per pole, said secondary bimetals having extending posts formed on a free end.

2. A multipole molded case circuit breaker as recited in claim 1, wherein said bimetals are disposed substantially perpendicular with respect to each other.

3. A multipole, molded case circuit breaker as recited in claim 1, wherein said secondary bimetals include extending posts.

4. A multipole molded case circuit breaker as recited in claim 1, wherein said detecting means includes three phase sensitivity levers adapted to be coupled to said secondary bimetals and engage said trip bar.

5. A multipole molded case circuit breaker as recited in claim 4, wherein each of said phase sensitivity levers is formed as an elongated member having an aperture at one end and elongated slot at the other end.

6. A multipole molded case circuit breaker as recited in claim 5, wherein said slot is disposed at an angle relative to said longitudinal axis of said elongated member.

7. A multipole molded case circuit breaker as recited in claim 6, wherein said elongated slots for each phase sensitivity lever are adapted to receive said extending post on said center pole secondary bimetal.

8. A multipole molded case circuit breaker as recited in claim 7, wherein said apertures on said phase sensitivity levers are adapted to receive said extending posts on outside pole secondary bimetals.

9. A molded case circuit breaker comprising:

a base;

a plurality of pairs of separable main contacts carried by said base;

an operating mechanism including a trip bar mechanically coupled to said plurality of pairs of separable main contacts for opening said separable main contacts on command;

means for sensing an overcurrent condition and actuating said operating mechanism in a predetermined time period including means for detecting an open circuit condition in less than all phases of a multiphase electrical load connected to said circuit breaker;

wherein said sensing means includes overload sensing means for sensing an overload condition;

wherein said overload sensing means includes a first bimetal adapted to engage said trip bar in an overload condition and spaced away from said trip bar a predetermined distance during normal operating conditions; and wherein said detecting means includes means for reducing said predetermined distance during an open circuit condition.

10. A multipole molded case circuit breaker comprising;

a base;

a plurality of pairs of separable main contacts disposed in said base;

means for opening said pairs of separable main contacts including a trip bar;

means for detecting an open circuit condition in an electrical load connected to said circuit breaker including means for interfacing said detecting means with said opening means which includes one or more movably mounted members disposed a predetermined distance from said trip bar during normal conditions adapted to engage said trip bar during an open circuit condition; and wherein said detecting means includes means for reducing said predetermined distance during a condition when one phase of an electrical load connected to said circuit breaker is open circuited.

11. A multipole circuit breaker comprising:

a base;

a plurality of pairs of separable main contacts disposed in said base;

means for opening said pairs of separable main contacts;

a trip unit operatively coupled to said opening means for actuating said opening means during an overcurrent condition in a predetermined time period including a plurality of bimetals;

means operatively coupled to said bimetals for detecting an open circuit condition;

wherein said detecting means includes means for actuating said trip unit;

wherein said actuating means includes a phase sensitivity lever and a trip lever; and wherein said trip lever is formed as an E-shaped member.

12. A multipole circuit breaker comprising:

a base;

a plurality of pairs of separable main contacts disposed in said base;

means for opening said pairs of separable main contacts;

a trip unit operatively coupled to said opening means for actuating said opening means during an overcurrent condition in a predetermined time period including a plurality of bimetals;

means operatively coupled to said bimetals for detecting an open circuit condition;

wherein said detecting means includes means for actuating said trip unit;

wherein said actuating means includes a phase sensitivity lever and a trip lever; and wherein said phase sensitivity lever is formed as an E-shaped member defining three depending legs.

13. A multipole circuit breaker as recited in claim 12 wherein bell cranks are formed on each of said depending legs.

14. A multipole circuit breaker comprising:

a base;

a plurality of pairs of separable main contacts disposed in said base;

means for opening said pairs of separable main contacts;

a trip unit operatively coupled to said opening means for actuating said opening means during an overcurrent condition in a predetermined time period including a plurality of bimetals;

means operatively coupled to said bimetals for detecting an open circuit condition;

wherein said detecting means includes means for actuating said trip unit;

wherein said actuating means includes a phase sensitivity lever and a trip lever; and wherein said phase sensitivity lever is connected to said trip lever at a pivot point.

15. A multipole circuit breaker as recited in claim 14 wherein said pivot point is fixed.

* * * * *